US009387569B2

(12) United States Patent
Blick

(10) Patent No.: US 9,387,569 B2
(45) Date of Patent: Jul. 12, 2016

(54) LEATHER HEAD FINISHING SYSTEM HAVING PLURALITY OF APERTURES AND ANGLED SHOE RAILS

(71) Applicant: John Blick, Laguna Beach, CA (US)

(72) Inventor: John Blick, Laguna Beach, CA (US)

( * ) Notice: Subject to any disclaimer, the term of this patent is extended or adjusted under 35 U.S.C. 154(b) by 115 days.

(21) Appl. No.: 13/872,099

(22) Filed: Apr. 27, 2013

(65) Prior Publication Data

US 2014/0323021 A1 Oct. 30, 2014

(51) Int. Cl.

| | |
|---|---|
| ***B24B 7/22*** | (2006.01) |
| ***B24B 23/02*** | (2006.01) |
| ***B24B 41/00*** | (2006.01) |
| ***B24B 45/00*** | (2006.01) |
| *B24B 23/04* | (2006.01) |
| *B24B 7/18* | (2006.01) |

(52) U.S. Cl.

CPC ..... *B24B 41/002* (2013.01); *B24B 7/22* (2013.01); *B24B 23/02* (2013.01); *B24B 45/006* (2013.01); *B24B 7/18* (2013.01); *B24B 23/04* (2013.01); *Y10T 403/56* (2015.01)

(58) Field of Classification Search

CPC ..... B24B 7/18; B24B 7/182; B24B 7/184; B24B 7/186; B24B 45/00; B24B 45/003; B24B 45/006; B24B 41/00; B24B 23/02; B24B 27/0076; B23C 5/2243; B24D 7/066; B24D 13/20; B27G 13/10; B28D 1/188; F16B 37/08

USPC ..... 451/350, 353, 359, 360, 363, 362; 15/49.1, 52.1, 50.1; 30/160, 161

See application file for complete search history.

(56) References Cited

U.S. PATENT DOCUMENTS

| | | | | | |
|---|---|---|---|---|---|
| 1,284,092 | A | * | 11/1918 | Gray | B23Q 5/04 144/38 |
| 3,401,417 | A | * | 9/1968 | Moughty et al. | 15/50.1 |
| 3,464,166 | A | * | 9/1969 | Bouvier | 451/548 |
| 3,898,770 | A | * | 8/1975 | Benz et al. | 451/286 |
| 4,219,898 | A | * | 9/1980 | Presby | 15/49.1 |
| 4,675,975 | A | * | 6/1987 | Kucharczyk | B23C 5/2243 144/219 |
| 4,691,403 | A | * | 9/1987 | Scharf | 15/114 |
| 4,939,872 | A | * | 7/1990 | Revelin et al. | 451/354 |
| 5,054,245 | A | * | 10/1991 | Coty | 451/353 |
| 5,567,503 | A | * | 10/1996 | Sexton | B24B 7/22 428/137 |
| 5,683,143 | A | * | 11/1997 | Peterson et al. | 299/41.1 |
| 5,927,264 | A | * | 7/1999 | Worley | 125/36 |
| 6,116,996 | A | * | 9/2000 | Yanase | 451/359 |
| 6,530,828 | B1 | * | 3/2003 | Kolthoff | 451/490 |
| 6,869,344 | B2 | * | 3/2005 | Miyahara et al. | 451/287 |
| 7,192,339 | B1 | * | 3/2007 | Harding | B24B 7/186 451/350 |
| 7,427,228 | B1 | * | 9/2008 | Kirsch | 451/357 |
| 7,587,779 | B2 | * | 9/2009 | Walz et al. | 15/49.1 |

(Continued)

OTHER PUBLICATIONS

CNC Tooling at Stone Pro Equipment.*

*Primary Examiner* — Joseph J Hail
*Assistant Examiner* — Arman Milanian
(74) *Attorney, Agent, or Firm* — Curtis L. Harrington; Harrington & Harrington

(57) ABSTRACT

A single and multiple abrasive structure support system has a multiple support structure which facilitates use of snail lock and Frankfurt shoe adaptive support with a stepped surface which enables the snail lock adapter to enabling support of an abrasive structure beyond and at a distance clearance from Frankfurt shoe rails. The single abrasive structure support includes a snail lock. Both single and multiple abrasive structure support systems incorporate a pair of plates for absorbing force and energy, especially resulting from uneven surfaces being textured, such as stone.

6 Claims, 11 Drawing Sheets

(56) References Cited

U.S. PATENT DOCUMENTS

2007/0167119 A1* 7/2007 Momosaki ..... 451/359
2007/0254568 A1* 11/2007 Park ..... 451/548
2008/0176497 A1* 7/2008 Estes ..... 451/490
2009/0156099 A1* 6/2009 Copoulos ..... 451/41
2012/0122378 A1* 5/2012 Van Eijden et al. ..... 451/64
2013/0178137 A1* 7/2013 Puchegger et al. ..... 451/461

* cited by examiner

LEATHER HEAD FINISHING SYSTEM HAVING PLURALITY OF APERTURES AND ANGLED SHOE RAILS

FIELD OF THE INVENTION

The present invention relates to improvements in the field of automated machine processing of surface polishing, finishing and texturing, and in particular abrasive structure supports, both single and multiple, which provide increased attachment and use access, and especially which adapt the snail lock or similar system for easier and more widespread use and enable both snail lock and Frankfurt shoe to be used in a multiple support device to enable users of general CNC machinery to more easily perform all of the above more easily.

BACKGROUND OF THE INVENTION

Known specialized machinery for surface texture processing is expensive. Abrasive media structures in specialized machinery utilize a large working tool support for applying an abrasive force to a material to be surface processed. Automatic surface treatment machines (which include polishing, texturing, brushing and the like) are powerful, and some method of providing abrasive force and power which protects the abrasive tools and machinery from damage should be used. Specialized abrasive media structures are typically used with a two plate driver system as a pair of plates arranged so that a bottom plate carries the abrasive media, a top plate drives the bottom plate through some vertically resilient structure which allows the bottom plate to be upwardly displaced by pressure of the surface being worked due to any non-flat areas of the surface (typically stone) being worked.

For users of general CNC vertical spindle machines for surface texture processing is fraught with problems, including problems with setup, problems with handling non-flat surfaces, and problems in setting up the use of a general vertical turning center to handle surface texturing. A specialized tool working support represents an investment for the user that may only engage with certain abrasive tools. A user must then purchase a variety of types of abrasive working support tools, one for every style and size of abrasive device to be used.

In other cases the user must either create that user's own specialized tool working support (an expensive and time consuming proposition) or try to clumsily modify other specialized tool working supports which may not be intended for use with the abrasive device in stock. A specialized tool working support may have such specific structures that gaining access to the structures to change them can be a significant and time-consuming challenge. In other instances, a user that has a particular type of specialized tool working support, may not have availability of the abrasive device needed, either in stock or available commercially.

Strength of mounting and ability for use of a variety of sizes of abrasive structures is also a problem. Conventional abrasive structures found around the shop and which have a manual grinder connection may be attempted to be used, but this type of manual connection while sufficient for manual use is weak by comparison and may likely break when used in automated machinery, causing damage beyond the damage just to the abrasive structures. The typical manual mounting system for abrasive structures is that of a snail lock device with a ⅝"-11 pitch or an M-16X2 female threaded opening for mounting to a manual grinder on one surface with a snail lock structure on the opposing surface allowing the device to be attached and driven by a hand held electric grinder. The attachment possible utilizing this type of connection is limited in strength of connection and is also limited in that no access is possible through the center of the device due to the small size of the connection, ⅝" diameter, and the fact that the connection is made via a threaded member that is solid in nature. In the case of a resilient device comprised of an upper and lower plate with an abrasive structure being mounted to the lower plate it is not possible to have access to the upper plate axially from the exposed side of the lower plate without disassembling the lower plate from the overall assembly, a time consuming procedure. As but one example, an extensive change out of the structures on the bottom plate might be required to switch from Frankfurt shoe style attached abrasive devices to a snail lock series of abrasive devices. Many hours can be spent over the course of a production year changing between the two systems. The economic disadvantages of the alternative of having a different system for each type of abrasive media are only made worse in the case of changing between different sizes and different types of abrasive devices.

For example, the conversion from a Frankfurt shoe to a snail lock system would involve un-bolting three pairs of angled shoe holders, at two bolts per holder, and bolting in for example three specialized female snail lock attachment plates, before locking the individual snail lock brush-type abrasives. If the user wanted to have a pair of different bottom plates upon which snail lock and Frankfurt shoe were attached, the bottom plate and all of its component parts would be required to remove and replace onto the structure supporting such plates.

Neither of these two onerous disassembly/assembly prospects is of much help to the CNC user who does not usually perform enough surface treatment to own a specialized surface texturing machine, and who needs to have surface treatment capability economically. Further, where the amount of surface finishing is even more occasional, a user's having to keep two or more sets of larger abrasive working tool holders is both expensive in terms of cost investment, tool storage, and sacrificed floor area.

Utilization of components is another factor. A specialized upper tool holder structure useful only for stone texturing, for example, and which is very rarely used represents an expenditure for a structure which is generally not utilizable elsewhere. Users need to have the ability for increased processing capability and task flexibility at a minimum investment cost and setup time, and with overall minimum idle inventory. Any system which can enable the least expensive and greatest flexibility use with minimum cost and time can become a valuable, cost advantage standard.

What is needed in the area of surface texturing is a system which will provide: (1) minimum changeover from one type of abrasive structure to the other, such as from Frankfurt shoe to snail lock; (2) Utilization of tool holders which are very likely already in the user's inventory; (3) easy access for inspection, assembly and dis-assembly should problems or the need for small repairs arise; (4) maximum utilization of different sizes of abrasive structures which the user has on hand; (5) an attachment system for abrasive tools which is forgiving of surface defects and protects against most types of breakage during surface texturing operations; and (6) a system having greater support for abrasive tools commensurate with the CNC environment.

SUMMARY OF THE INVENTION

A system is disclosed which embodies the ability to enable a user to have ease of use of a single or multiple snail lock brush-type abrasive in more than one size (typically four inch and five inch diameter, with the five inch diameter system also having the capability of six inch structures). The heart of the system is a snail lock adapter having a number of advantageous characteristics including: (1) the ability to mount the adapter into a threaded aperture or bore, (2) a relatively large diameter (two and a half inches) to enable access through the adapter either in the direction of the adapter's attachment to another structure or to the snail lock or other component it secures, (3) the stepped ability to mount the adapter so as to accommodate or provide clearance to other structures, such as the Frankfurt shoe, and (4) quick change ability due to the use of a washer in conjunction with threaded components to inhibit sticking. A multiple or single abrasive structure support also gives the ability for it to be attached to other structures using a center placed, easily accessible hole which can be engaged by a number of structures.

A system is disclosed which embodies the ability to quickly interchange between different sizes and styles of abrasive structures, as well as a resilient plate system which works with a standard tool holder. More specifically, the system includes a large dual plate resilient structure with three pairs of Frankfurt shoe rails and three threaded openings accommodating snail lock adapters each of which fit within the area of the three pairs of Frankfurt shoe rails without either interfering with, or being interfered with the Frankfurt shoe rails. The accommodating snail lock adapters support the brush-type snail lock abrasives using a large thread engagement with the bottom plate and support the brush-type snail lock abrasives in a position displaced farther from the bottom plate by the height of the Frankfurt shoe rails. Switching from snail lock to Frankfurt shoe abrasive structures is as simple as easily unscrewing and removing the three accommodating snail lock adapters. Once the adapters are removed, the Frankfurt shoe style abrasive structures can be slid between the Frankfurt shoe rails and into a radially outward most and even locking position and held in place by centrifugal rotation of the bottom plate during the stone texturing process, for example. Although the multiple abrasive structure support has three abrasive structure support positions, a two position, or four or more position system is contemplated.

Alternatively, if it were desired to use the large dual plate resilient structure with the three pairs of Frankfurt shoe rails removed, absent or simply not needed, a set of three snail lock adapters lacking an accommodating step could be used to threadably attach to the bottom plate and to accept the snail lock supported abrasive structures. In the case of the large dual plate resilient structure, it is driven by an ordinary tool holder. Thus, when the large dual plate resilient structure is not being used, its tool holder can be employed elsewhere if so desired.

The system also includes a small dual plate resilient structure which is utilizable with the aforementioned snail lock adapters lacking an accommodating step (where it is desired to reduce the effective height by the absence of the accommodating step) and which is threaded into a large diameter threaded bore in a bottom small plate which is resiliently mounted with respect to a top small plate in a manner similar to that for the large dual plate resilient structure. Changing from one size of snail lock abrasive structure to another size of snail lock abrasive structure (for example from a four inch diameter abrasive structure to a five inch diameter abrasive structure) simply involves changing out the aforementioned snail lock adapters (for example from a four inch diameter adapter to a five inch diameter adapter). The small dual plate resilient structure is also driven by an ordinary tool holder and when the small dual plate resilient structure is not being used, its tool holder can be employed elsewhere if so desired.

The large and small dual plate resilient structure provides a central opening in the lower plate to enable access to an end cap secured with a bolt. Coolant flow through capability is an incidental aspect of the inventions. Depending upon the thickness of the plates and the size of the end caps, a number of spacers may be provided to provide spacing between the end cap and the bottom of the top plate to enable the ordinary tool holder to be securely attached to the top plate. A typical ordinary tool holder which works well is the 35 millimeter toolholder inserted into a corresponding aperture in the top plate and secured with the end cap and possibly spacers. The attachment of the ordinary tool holder into either top plate of the large and small dual plate resilient structure occurs in the same way.

To further facilitate manipulation and ease of handling, a pair of bar wrenches with pin projections may be provided. The bar wrenches can fit through openings in the structures which connect the two plates and the bar wrench pins can engage small blind bores placed strategically in the material to facilitate engagement and turning with respect to the large and small dual plate resilient structure and also for stability during manipulation of the bolt securing the end cap, and the snail lock adapters. Snail lock adapters may preferably be secured by a two and a half inch diameter one-eighth inch pitch connection. Nylon gaskets can be used between a large or small lower plate and the snail lock adapters to prevent marriage of materials, especially under threaded friction connectivity. The position of turning of the large and small dual plate resilient structure will preferably be in a direction such as will cause secure tightening of the snail lock adapters.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
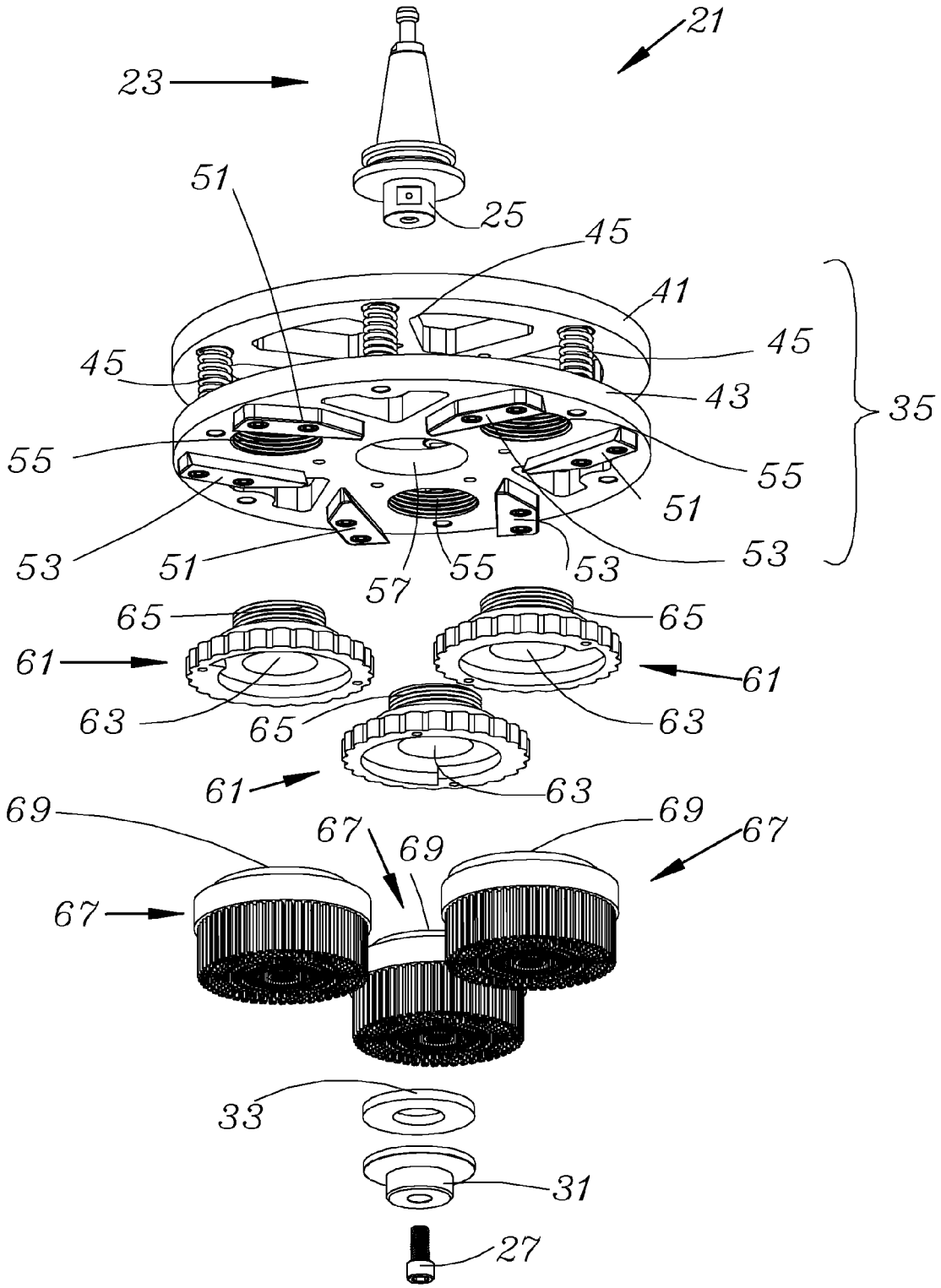
FIG. 1 is a perspective view looking upward into a large dual plate resilient abrasion support head with the tool holder shown exploded above as it might be during removal of the tool holder after use, and predominantly with the bottom structures shown exploded in a manner in which a user might convert from Frankfurt shoe to snail lock usage.

Referring to FIG. 1, a partially exploded perspective view looking upward and underneath a LEATHER HEAD or multiple abrasive structure support 21 is shown. In the description that follows an ordinary tool holder 23 will be illustrated as the structure which enables support of the multiple abrasive structure support 21, although a variety of other structures could be used. Ordinary tool holder 23 may have a thirty-five millimeter insertion or securing portion 25. This illustrates that the ordinary tool holder 23 may be removed from the multiple abrasive structure support 21 and placed into other service. Ordinary tool holder 23 may be secured against another structure using a bolt 27. Bolt 27 secures an end cap 31 which may compress an optional spacer ring 33.

Continuing to Refer to FIG. 1, and beneath the ordinary tool holder 23, a resilient two plate support assembly 35 is shown. A top plate 41 is mounted to a bottom plate 43 by a series of spring assemblies 45. The spring assemblies 45 enable the bottom plate 43 to rise to compress against the top plate 41 against the pressure from the spring assemblies 45. As will be seen, the spring assemblies include a controlled sliding of the bottom plate against the top plate, and insure that any turning force exerted on the top plate 41 will be instantly and tightly transmitted to the bottom plate 43.

Continuing to Refer to FIG. 1, and beneath the bottom plate 43 three pairs of Frankfurt shoe rails are seen as a first rail 51 and a second rail 53 in each two rail pair. Seen between each pair of first and second rails 51 and 53 is a threaded bore 55 extending into the bottom plate 43. Bottom plate also has a central smooth bore access aperture 57 which enables access to the thirty-five millimeter toolholder 23 insertion or securing portion 25 so that the bolt 27 can be easily tightened and loosened.

Beneath and separated from the bottom plate in FIG. 1 are a series of three snail lock adapters 61. Each snail lock adapter 61 has a female snail lock opening 63 and a male thread 65 for engaging the threaded bore 55 extending into the bottom plate 43 to secure the three snail lock adapters 61 to the bottom plate. Male thread 65 surrounds a wide bore 66 which allows for access into and through the snail lock adapters 61 from the top, or point of attachment to the lower plate 43 as well as quick threaded insertion and removal from the bottom plate 43. The design of the snail lock adapter 61 makes it easy to install on any structure with the simple expedient of forming a threaded hole. Support for snail lock adapters 61 using can then be derived with a wider stance, stronger mounting and onto a larger structure while also providing access to other surfaces axially superior to the snail lock adaptor 61 itself. Beneath the three snail lock adapters 61 are see a series of brush-type abrasive structures 67, each having a male snail lock member 69 at its top side for enabling lockable securing of the brush-type abrasive structures 67 into the snail lock adapters 61. Into the male snail lock member 69, a bore 70 may already exist as it aids in threaded attachment to ordinary grinders.

Figure 2:
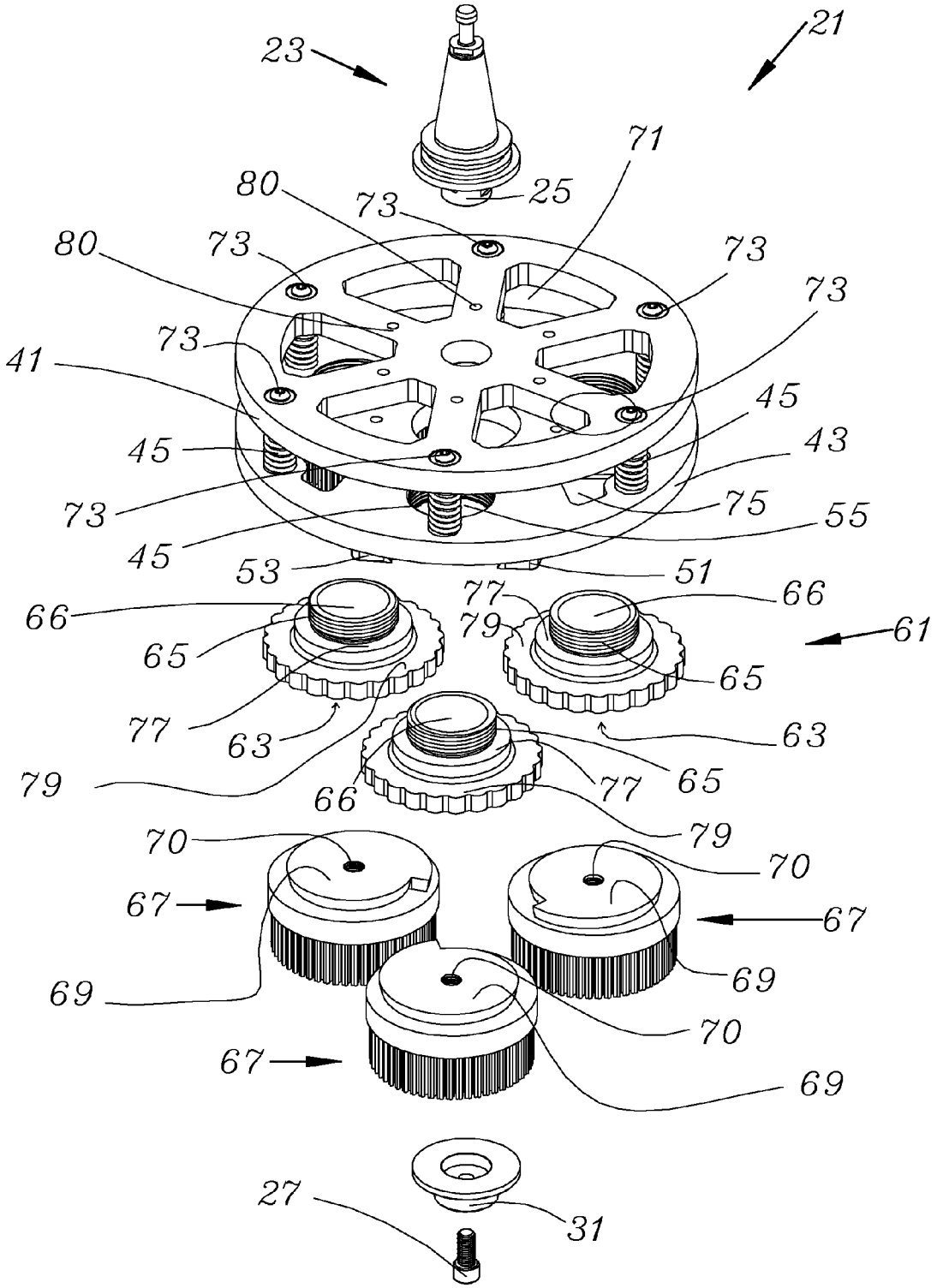
FIG. 2 is a similar exploded view as seen in FIG. 1, but taken from the top and illustrating further details of components not seen in FIG. 1.

Referring to FIG. 2, a similar exploded view as seen in FIG. 1, but taken from the top, illustrates further details of components not seen in FIG. 1. Top plate 41 is seen to have a series of 6 openings 71 to both lighten the multiple abrasive structure support 21 and to provide manual access to any structure inside the multiple abrasive structure support 21, between top plate 41 and bottom plate 43. A central thirty-five millimeter aperture 72 will interfit with the thirty-five millimeter insertion or securing portion 25 of ordinary tool holder 23. A series of bolts 73 (heads are seen) which have an abbreviated threaded section for direct threaded engagement into lower plate 43.

One of a series of openings 75 are seen in the bottom plate 43 to both lighten the multiple abrasive structure support 21, to provide even further additional manual access to any structure inside as well as to allow coolant to pass through the plate to the material being worked by the device. Some further detail of the three snail lock adapters 61 are seen including an extension step 77 which is used to limit the extent of travel of the male thread 65 into the threaded bore 55 so that a flat back 79 of the structure of the snail lock adapter 61 supporting the female snail lock opening 63 (indicated by a hooked underside pointing arrow) will be spaced apart from an underside of the bottom plate 43 by a distance sufficient that the flat back 79 of the structure of the snail lock adapter 61 supporting the female snail lock opening 63 will clear and not touch or interfere with the first and second Frankfurt shoe rails 51 and 53. A series of openings 80 (which can be a bore) are seen on the top of the upper plate and will also been seen on different structures to facilitate engagement and turning by a bar wrench which has projections that engage such placed blind bores. The use of openings 80 which enable engagement with a bar wrench will assist the user in turning, stabilizing, and manipulating other structures while keeping the multiple abrasive structure support 21 steady.

Figure 3:
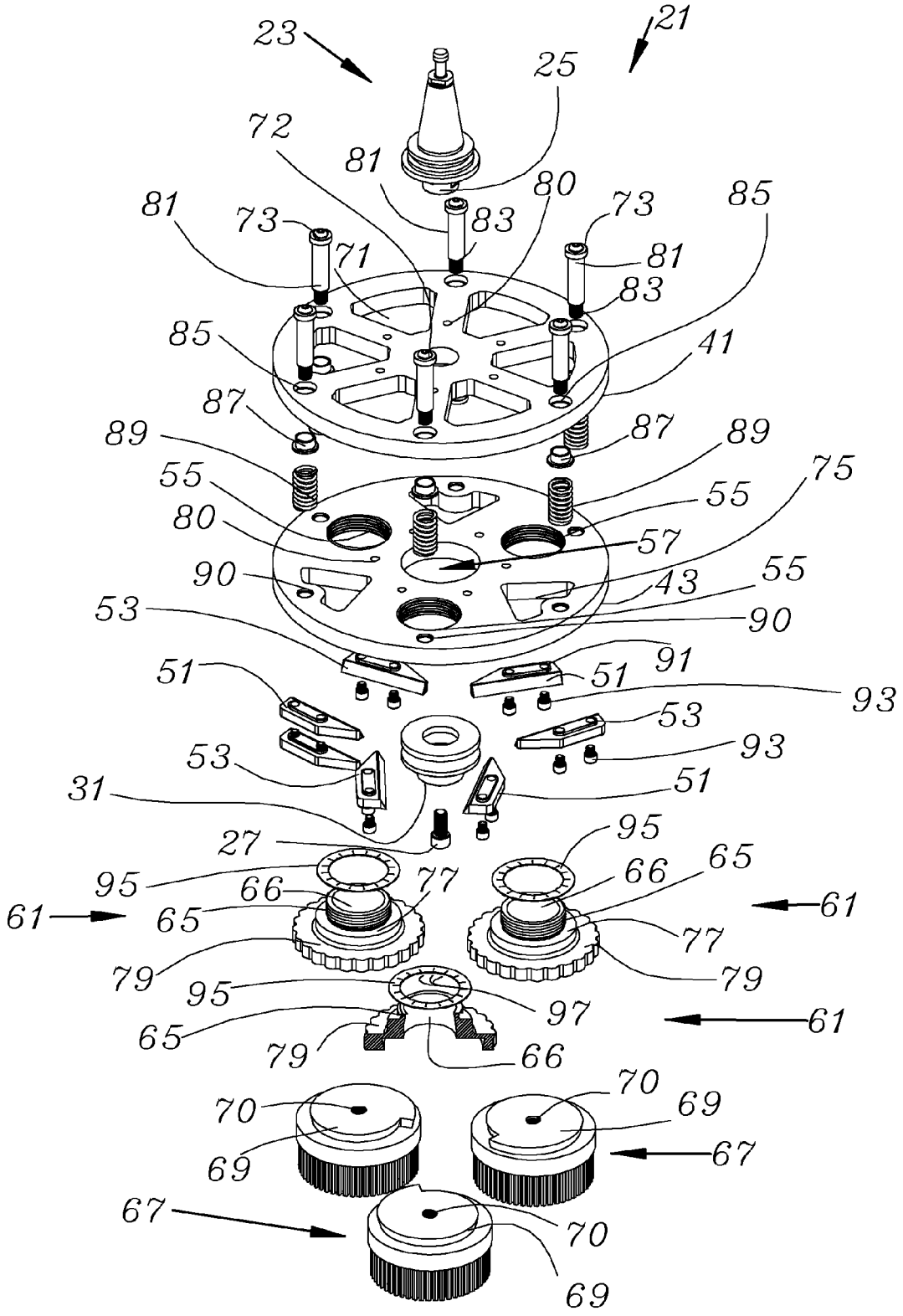
FIG. 3 is a complete exploded view of the multiple abrasive structure support which enables illustration of still further structures.

Referring to FIG. 3, a complete exploded view of the multiple abrasive structure support 21 enables illustration of still further structures. The series of bolts 73 are shown to have a smooth main portion 81 over a significant part of its length, terminating at an abbreviated threaded section 83. Bolts 73 pass through apertures 85 located in upper plate 41. Directly underneath the threaded bores 85 a series of bushings 87 are seen, which will surround the smooth main portions 81 and which may preferably provide the closest bearing against the smooth main portions 81 when the bottom plate 43 rises under pressure to push the bolts 73 above the surface of the top plate 41, especially against the downward bearing force of a set of associated springs 89 which bearingly oppose upon both the bushings 87 and the bottom plate 43. Bushings 87 may be preferably made of brass, while the top and bottom plates 41 and 43 may be made of aluminum. The series of bolts 73 abbreviated threaded section 83 is for direct threaded engagement into threaded apertures 90 located in lower plate 43.

also seen in exploded view are the Frankfurt shoe first and second rails 51 and 53, each of which has a bolt aperture 91 for enabling them to be secured to the underside of bottom plate 43 with bolts 93. Also seen for the first time are washers 95 which may be made of plastic, nylon or the like and which have a series of radial cuts 97 which enable the washers 95 to be fitted over the male thread 65 of its associated snail lock adapter 61. The washer will help prevent metal to metal bonding between the radial face of the extension step 77 and the material of the underside of the lower plate 43 adjacent the threaded bore 55 extending into the bottom plate 43. One of the snail lock adapters 61 is shown in sectional view to illustrate its side sectional profile.

Figure 4:
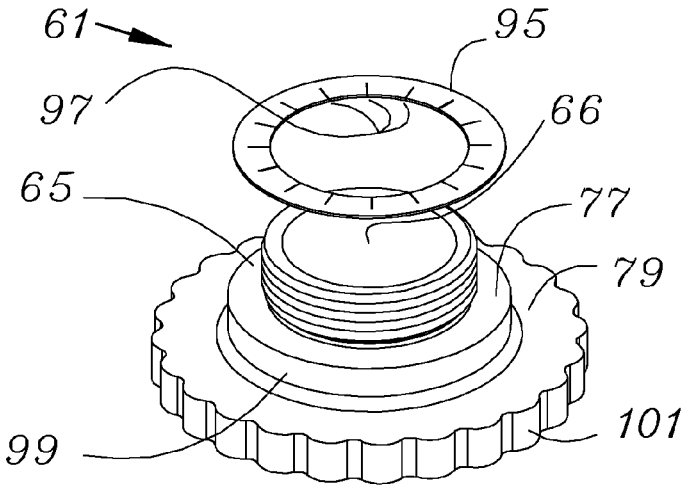
FIG. 4 is a closeup perspective view of the snail lock adapter shown in FIGS. 1-3.

Referring to FIG. 4, a closeup perspective view of the snail lock adapter 61 shown in FIGS. 1-3 further illustrates a general outwardly radial surface 99 having an axial height which generally represents a magnitude which is sufficient to lift the flat back 79 of the structure of the snail lock adapter 61 supporting the female snail lock opening 63 to a position over and accommodating the height of the Frankfurt shoe first and second rails 51 and 53. Also seen is a scalloped outer surface 101 at an outer periphery of the snail lock adapter 61 which can assist in manual turning of the snail lock adapter 61.

Figure 5:
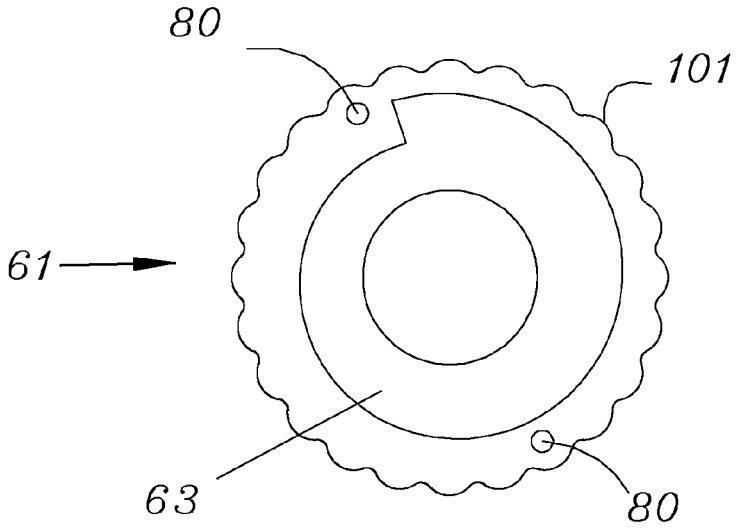
FIG. 5 is a closeup bottom view of the snail lock adapter shown in FIGS. 1-4 and illustrating the female snail lock connector and blind bores for engagement with a bar wrench.
Figure 6:
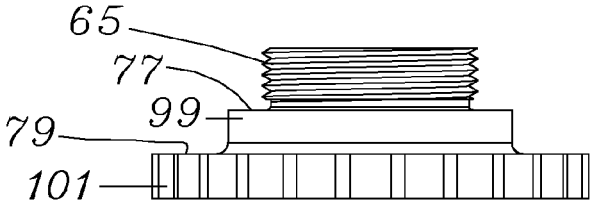
FIG. 6 is a closeup plan view of the snail lock adapter shown in FIGS. 1-5.

FIG. 5 is a closeup bottom view of the snail lock adapter 61 shown in FIGS. 1-4 and illustrating a view looking into the female snail lock opening 63. Also seen are a pair of the openings 80 which may be located on a number of components shown in the drawings, including the multiple abrasive structure support 21. Referring to FIG. 6, a closeup plan view of the snail lock adapter 61 shown in FIGS. 1-5 is illustrated.

Figure 7:
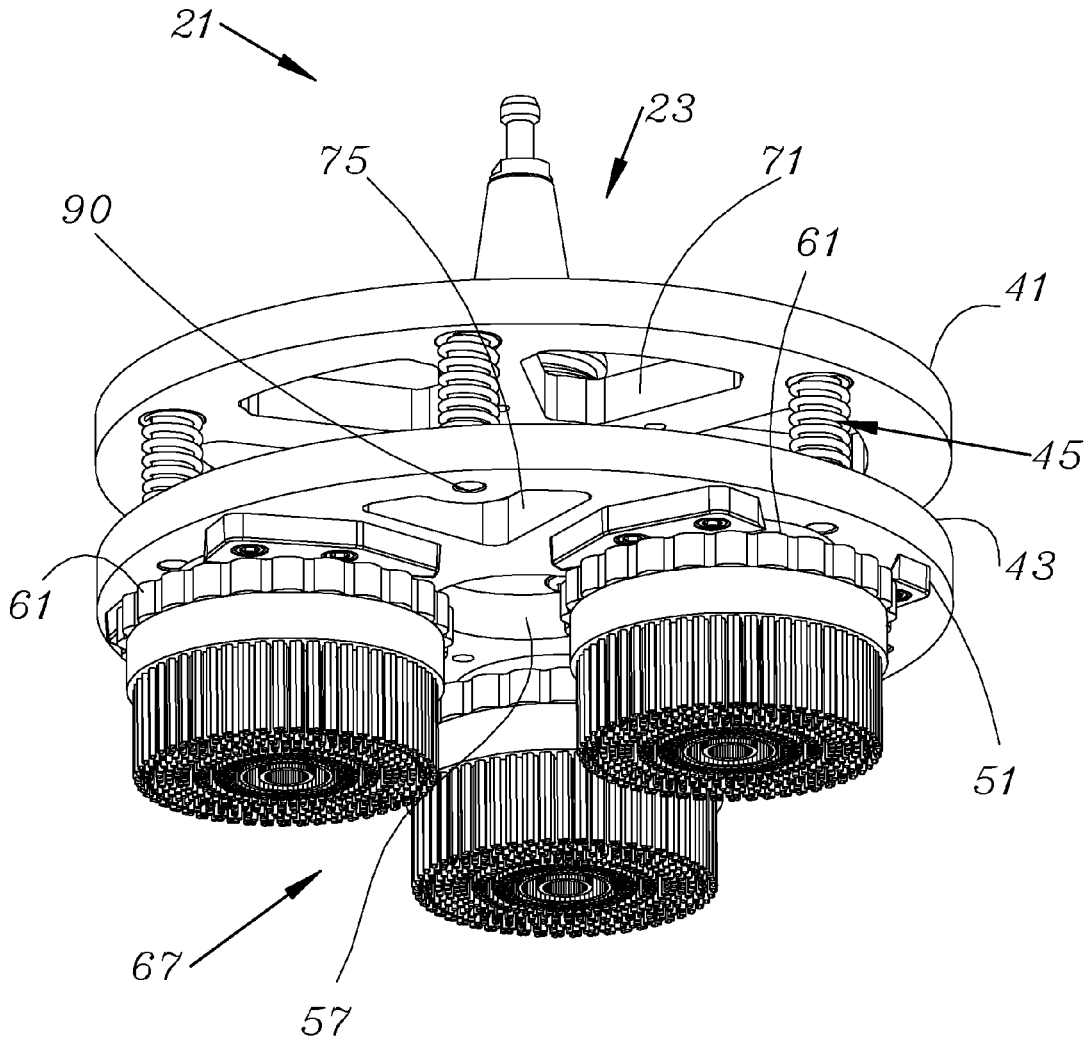
FIG. 7 is a perspective view of the assembled multiple abrasive structure support configured with three snail lock adapters and series of brush-type snail lock abrasive structures.
Figure 8:
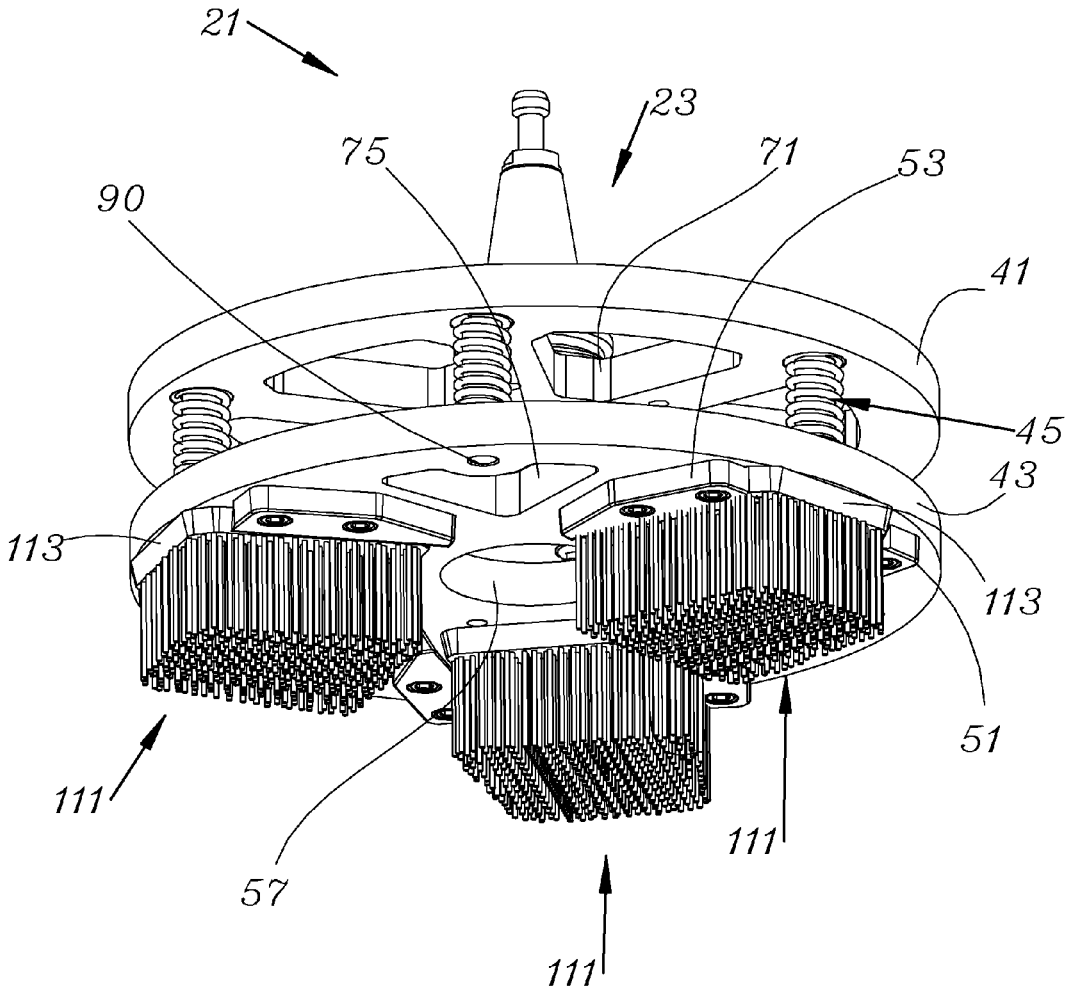
FIG. 8 is a perspective view of the assembled multiple abrasive structure support with the three snail lock adapters and series of brush-type snail locked abrasive structures removed and shown with a set of three Frankfurt shoe supported abrasive members in place between Frankfurt shoe first and second rails.

Referring to FIG. 7, a perspective closeup view of the assembled multiple abrasive structure support 21 configured with three snail lock adapters 61 and series of brush-type abrasive structures 67 is shown. The three snail lock adapters 61 are shown with the scalloped surfaces 101 at their outer periphery, with the scalloped surfaces 101 extending over and out of interference with the Frankfurt shoe first and second rails 51 and 53. The threaded bores 85 located in lower plate 43 can also be seen. Referring to FIG. 8, a similar view of the multiple abrasive structure support 21 is shown with the three snail lock adapters 61 and series of brush-type abrasive structures 67 removed, and with a set of three Frankfurt shoe supported abrasive members 111 in place. The abrasive members 111 include a base 113 which is locked into place with respect to the Frankfurt shoe first and second rails 51 and 53.

Figure 9:
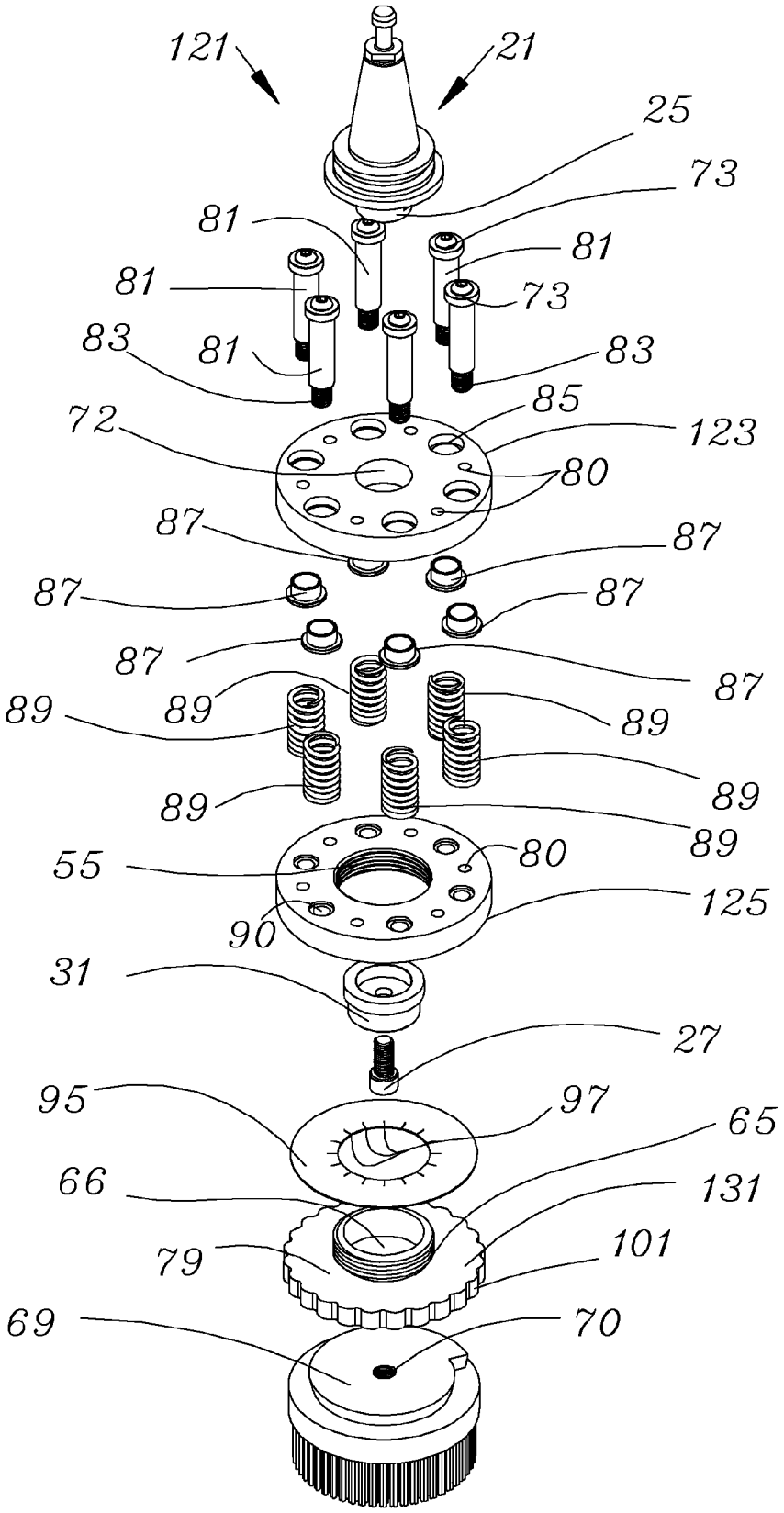
FIG. 9 is a perspective exploded view looking downward into a second embodiment which is a small dual plate resilient abrasion support head.

Referring to FIG. 9, a perspective exploded view looking downward into a small dual plate resilient abrasive support 121 is shown. Many of the smaller components which were associated with the multiple abrasive structure support 21 are used in conjunction with the small dual plate resilient abrasive support 121, and those components will retain the same numbering as was used in FIGS. 1-8. This points out a further advantage of having both the multiple abrasive structure support 21 and the small dual plate resilient abrasive support 121 available, namely a smaller supply of spare parts are needed because of the shared component parts. The main difference between the large (multiple) support 21 and the small support 121 is the smaller size dual plate sets that provide centered support for a single snail lock adapter 61 for mounting a single abrasive structure.

Continuing to Refer to FIG. 9, and beneath the ordinary tool holder 23, a small resilient two plate support assembly includes a small top plate 123 mounted to a small bottom plate 125 using the same components earlier discussed. The small top plate 123 is seen as having a central thirty-five millimeter aperture 72 for interfitting with the thirty-five millimeter insertion or securing portion 25 of ordinary tool holder 23. A series of openings 80 are seen in the a small top plate 123 and small bottom plate 125 for interfitting with pair of bar wrenches with pin projections to be shown later.

Small bottom plate 125 has a single, centrally located threaded bore 55 instead of multiple threaded bores 55. A snail lock adapter 131 is provided and can be termed "low height" because it does not need extension step 77 and a general outwardly radial surface 99 having an axial height to enable a flat back 79 of the structure of the snail lock adapter 61 supporting the female snail lock opening 63 to clear Frankfurt shoe first and second rails 51 and 53 which were present underneath bottom plate 43 of multiple abrasive structure support 21 seen in FIGS. 1-8.

Snail lock adapters 131 can be used with bottom plate 43 of multiple abrasive structure support 21 seen in FIGS. 1-8 if the Frankfurt shoe first and second rails 51 and 53 are not present. In general, the extra height of one or two centimeters present in snail lock adapter 61 can either be tolerated in the large (multiple) support 21 (even where the Frankfurt shoe first and second rails 51 and 53 are not present), or in the small support 121. This is another instance were interchangeable parts between the between the large (multiple) support 21 and the small support 121 will enable the use of a single size set snail lock adapters 61 in both the supports 21 and 121 where the centimeter or two height addition is of no consequence. Conversely, the supports 21 and 121 can both utilize the snail lock adapters 131 where Frankfurt shoe first and second rails 51 and 53 of support 21 are not present.

The snail lock adapter 131 still has male thread 65, which is preferably a two and a half inch-eight pitch UNC thread, a wide bore 66 as an axial access opening, flat back 79 of the structure of the snail lock adapter 61 supporting the female snail lock opening 63 having a radially outwardly exposed scalloped surface 101. Snail lock adapter 131 merely lacks extension step 77 and a general outwardly radial surface 99 between the male thread 65 and the flat back 79. Snail lock adapter 61 can also be used, thus contributing to more effective commonality among component parts for a user.

Figure 10:
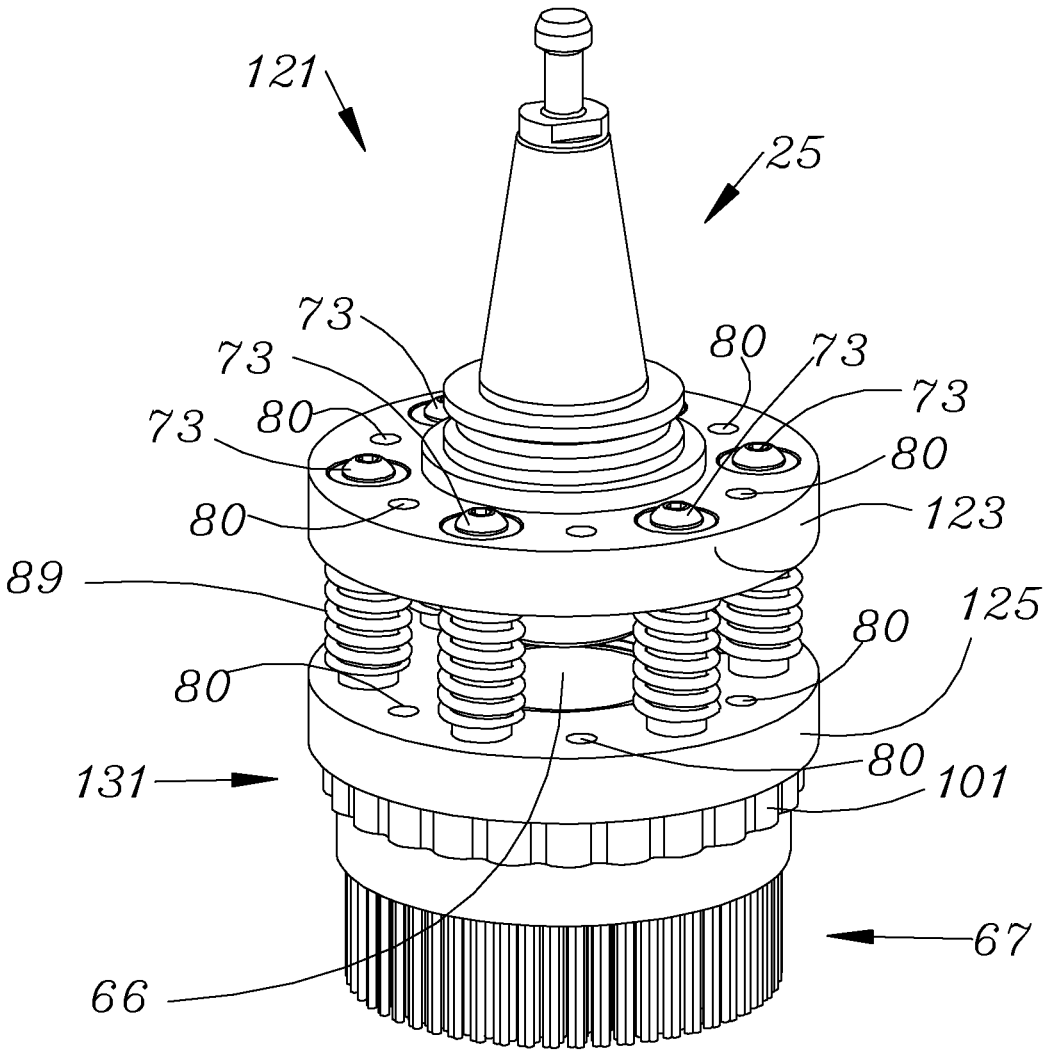
FIG. 10 is a perspective view of the small dual plate resilient abrasion support head of FIG. 9 but shown in assembled position.
Figure 11:
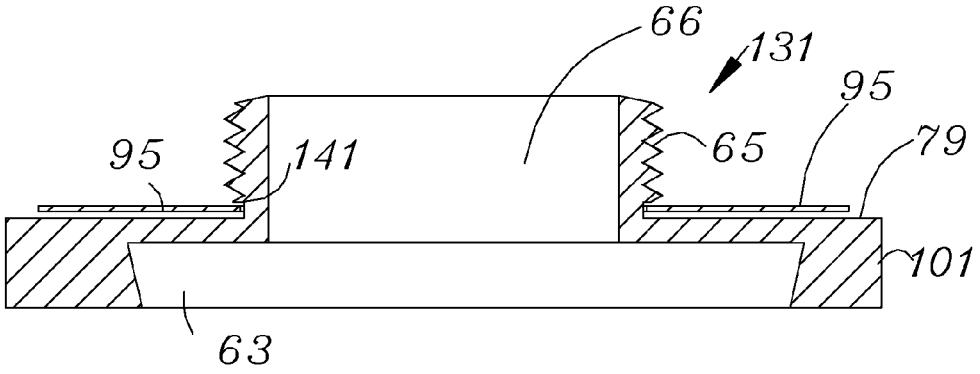
FIG. 11 is a sectional view of the snail lock adapter shown in FIGS. 9 & 10 which lacks the extension step and general outwardly radial surface which provide an axial extension of the snail lock adapter shown in FIGS. 1-3.

Referring to FIG. 11, a sectional view of the snail lock adapter 131 shown in FIGS. 9 & 10 is shown in cross section with the washers 95 in place and partially extending in a groove 141 formed between male thread 65 and flat back 79. Axial access opening wide bore 66 and female snail lock opening 63 are also seen. FIG. 11 emphasizes the relatively lower height of snail lock adapter 131 as compared to snail lock adapter 61.

Figure 12:
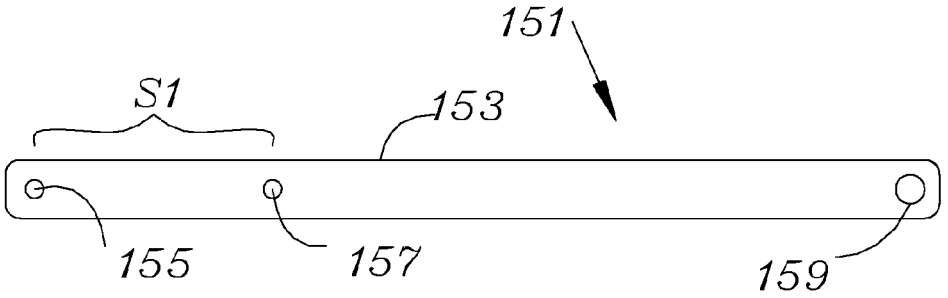
FIG. 12 is a plan view of a first embodiment of a wrench which is utilizable predominantly with either the multiple abrasive structure support or the small dual plate resilient abrasive support.

Referring to FIG. 12, a plan view of a wrench 151 which is utilizable with either the multiple abrasive structure support 21 or the small dual plate resilient abrasive support 121, is illustrated. The wrench 151 may be made of one quarter inch thick flat bar stock base 153 having a width which can be inserted between spring assemblies 45 and has been found to work well where this is one inch. The wrench may have an overall length sufficient to provide torque manipulation and fourteen inches has been found to work well. Wrench 151 is a one sided wrench and includes a pair of projections including a first projection 155 near one end of bar stock base 153, and a second projection 157 spaced apart from first projection 155 by a distance "S1" is provided to match the spacing of openings 80 located on supports 21 and 121 as needed. It has been found that a spacing "S1" between projections 155 and 157 of about 4.076 inches works well with openings 80 which have diameters slightly oversized with regard to the diameters of projections 155 and 157 which have a nominal four inch separation, and may be rounded at the top and may project about one half inch above the bar stock base 153. A hole or aperture 159 may be provided at an end opposite projection 155 for attachment of the wrench 151 to other structures.

Figure 13:
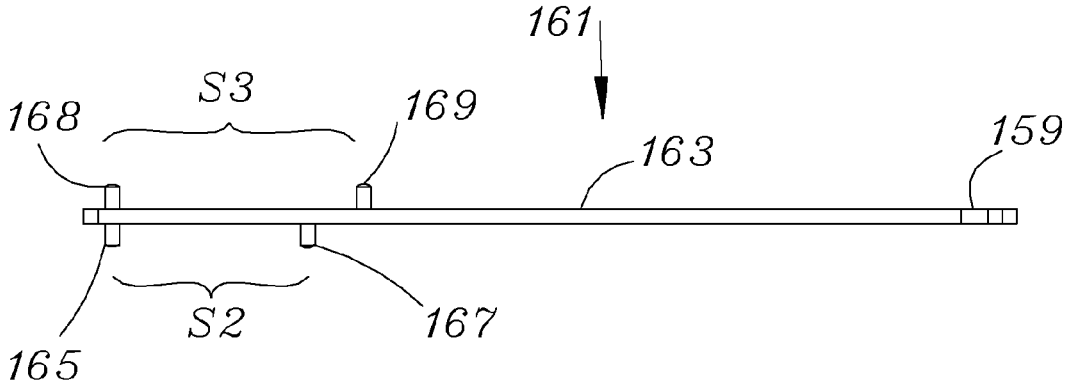
FIG. 13 is a plan view of a second embodiment of a wrench which is utilizable predominantly with the snail lock adapters having corresponding blind bores, used to tighten or loosen the snail lock adaptors mounted on either the multiple abrasive structure support or the small dual plate resilient abrasive support. One side of the wrench has protruding pins located in such a pattern as to engage one size snail lock adaptor while the other side of the wrench has protruding pins located in such a pattern as to engage a second size snail lock adaptor.

Referring to FIG. 13, a plan view of a wrench 161 which is utilizable predominantly with the snail lock adapters 61 and 131, but may be used with any openings 80 located on any component of either the multiple abrasive structure support 21 or the small dual plate resilient abrasive support 121, is illustrated. The wrench 161 may be made of one quarter inch thick flat bar stock base 163 having a width which can enable insertion where needed and may preferably be a two sided wrench. A width that has been found to work well is one inch. The wrench may have an overall length sufficient to provide torque manipulation and fourteen inches has been found to work well.

Wrench 161 may have multiple projections which facilitate manipulation of a number of sizes of components, including different sizes of snail lock adapters 61 and 131 which currently commonly include sizes of four and five inch diameters with the five inch diameter snail lock having the ability to accommodate both five and six inch abrasive structures. On wrench 161, a plurality of projections including a first pin member 165 (which may be realized as a two-sided projection pin and thus may be a pin structure which projects from both sides of the wrench 161, although the pins projections will be dealt with singly). On one side of wrench 161 and nearest one end of bar stock base 163, a second projection 167 protrudes from wrench 161 and is spaced apart from first projection 165 by a distance "S2". On the other side of wrench 161 and nearest the same end of bar stock base 163, a third projection 168 protrudes from wrench 161 and is spaced apart from a fourth projection 169 on that side by a distance "S3". The pin distances "S2" and "S3" are provided to match the spacing of openings 80 located on snail lock adapters 61 and 131 of different sizes and perhaps other structure on supports 21 and 121 as may be provided. It has been found that a spacing "S2" of about 3.436 and "S3" of about 4.436 inches works well for sizes of snail lock adapters 61 and 131. A hole or aperture 159 may be provided at an end opposite dual pin projection 165 for attachment of the wrench 161 to other structures.

The inventive system shown in FIGS. 1-13 disclose a structure which allows owners of standard CNC machinery to inexpensively and effectively perform texturing and finishing of stone and other materials. A manual grinder using the much smaller and less reliable ⅝"-11 pitch or M-16X2 connector system stands in contrast to the strength, interchangeability and reliability of the inventive system of FIGS. 1-13. A manual grinder will be illustrated to facilitate this comparison.

Figure 14:
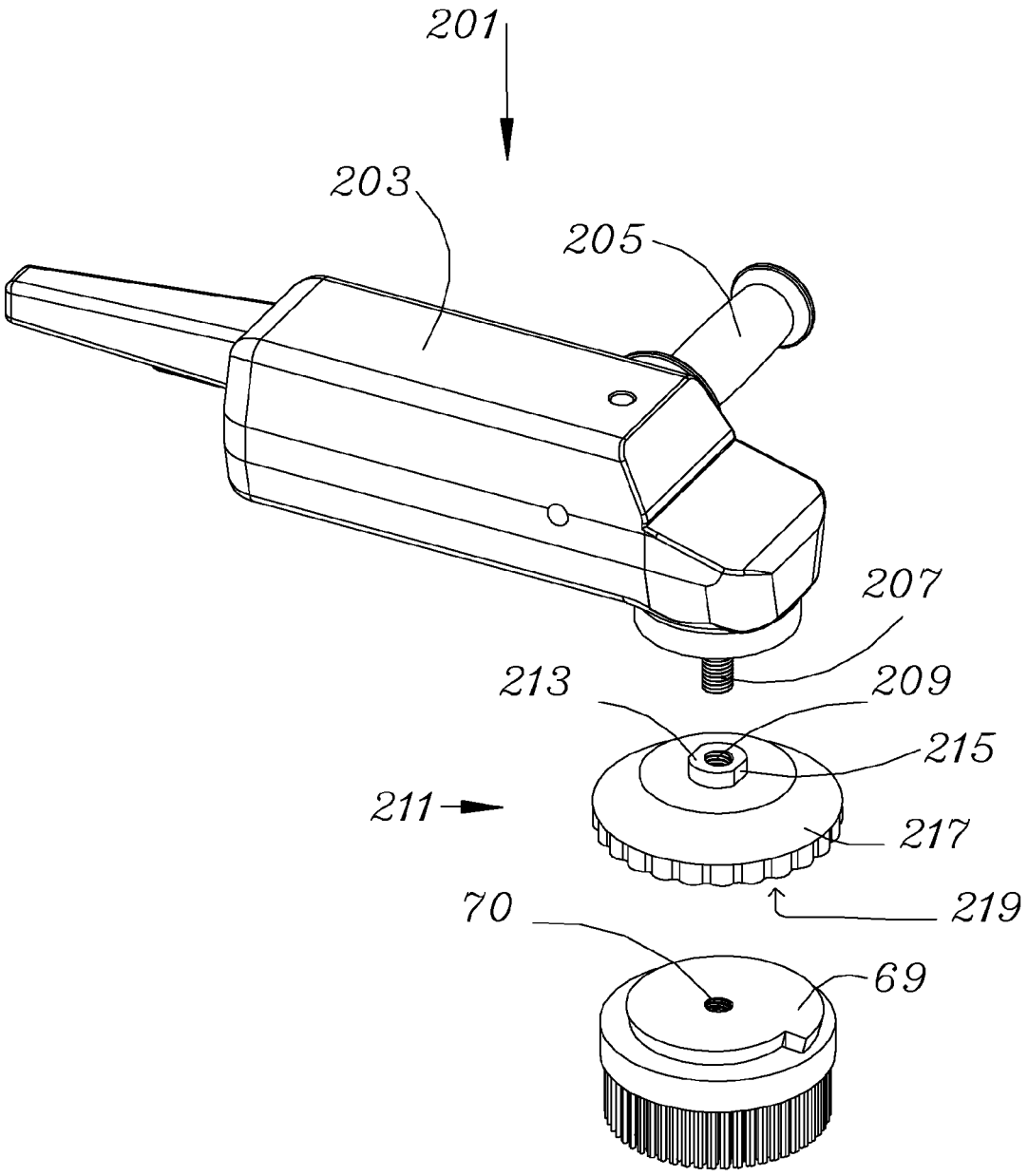
FIG. 14 is a partially exploded view of a manual grinder using the much smaller and less reliable "⅝-11 pitch or M-16X2 connector system in contrast to the strength, interchangeability and reliability of the inventive system of FIGS. 1-13.
Figure 15:
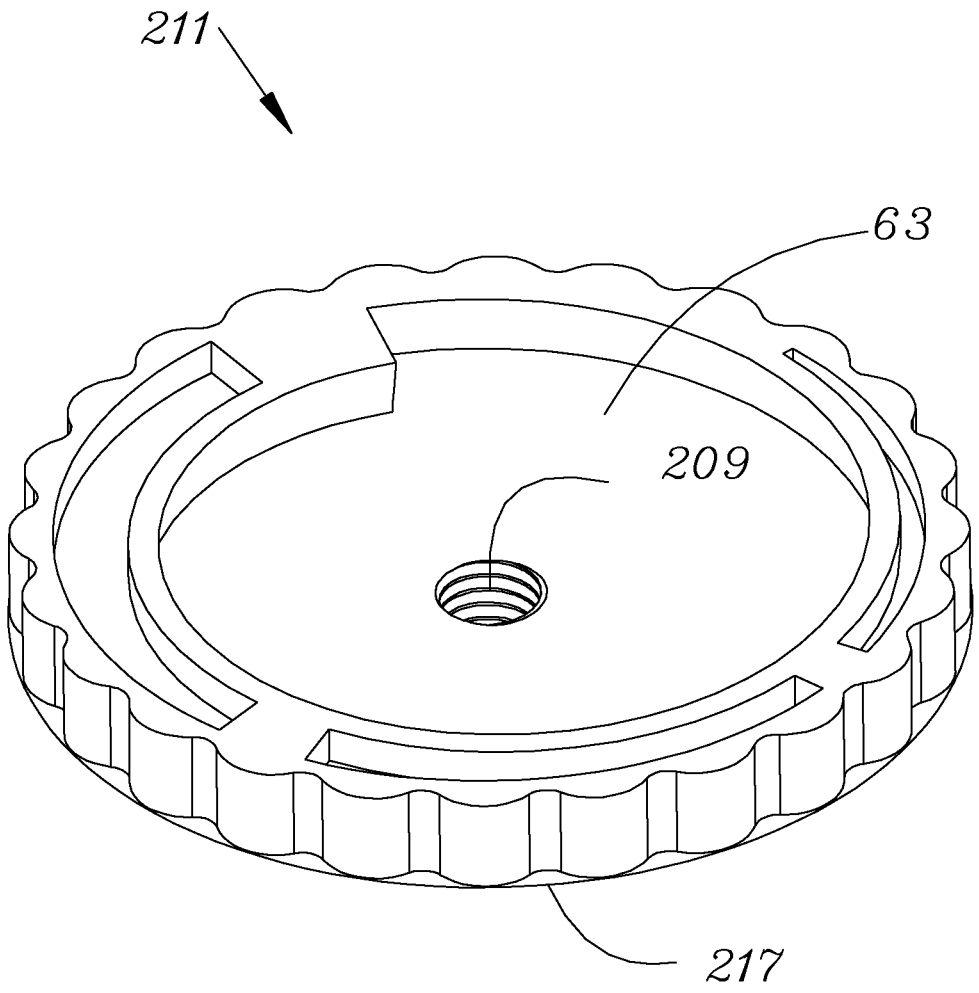
FIG. 15 is a perspective view of the underside of a hand grinder ⅝-11 or M-16X2 snail lock connector seen in FIG. 14.

Referring to FIG. 14, a perspective partially exploded view of a manual grinder system 201, electrically or pneumatically powered, having a housing 203 and handle 205 and operatively drives a shaft 207 having a ⅝ inch-11 pitch or M-16X2 terminal end connector system in contrast to the strength, interchangeability and reliability of the inventive system of FIGS. 1-13. The threaded end of shaft 207 connects into a threaded bore 209 of a manual snail lock support 211. The manual snail lock support 211 may include a boss 213 having opposed flat sides 215 to facilitate turning the manual snail lock support 211 to disengage it from the shaft 207. A curved bowl structure 217 supports the female snail lock 219 on the underside indicated with a curved pointing arrow. Other structures are as previously described. Even with manual control of the housing 203 and handle 205, the pressure which can be brought to bear on the manual snail lock support 211 through the shaft 207 is only a fraction of the forces possible with a general CNC machine and any such manual system lacks the consistent controllability available from CNC machines. As such, the inventive structures shown in FIGS. 1-13 are seen to have the ability to handle significantly more force and provide much more consistent control in a much more stable way than the manual grinder system 201. Further, the Snail lock adapter 61, 131 can be placed on any type of structure, especially any type of structure utilizable with a CNC machine. Referring to FIG. 15, the underside of the manual snail lock support 211 is shown.

While the present invention has been described in terms of a system for multiple or single abrasive structure support, using components common to each, and to a snail lock adapter which operates in the presence of and without the need to remove a set of Frankfurt shoe rails, the structures techniques employed herein are applicable to a wide range of devices and methods.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An abrasive structure support comprising: a top plate; a bottom plate attached to the top plate and resiliently urged downwardly by the top plate, the bottom plate including a plurality of apertures; a plurality of snail lock adapters each having a body having a first end for threaded connection through its associated one of the plurality of apertures, the first end having a boss having a male thread fittable within and threadably engageable with its associated one of the plurality of apertures and a wide bore axial access opening extending through the boss and through a second end of the body, the second end of the body including a female snail lock connector for connection to another structure having a male snail lock connector; and pairs of angled shoe rails located on the bottom plate such that each of the plurality of apertures are in between each pair of angled shoe rails.

2. The plurality of snail lock adapters as recited in claim 1 wherein the body includes an outer periphery and a flat back surface between the boss of the first end of the body and the outer periphery.

3. The plurality of snail lock adapters as recited in claim 2 wherein the outer periphery includes a scalloped surface to facilitate manual grasping and turning of the snail lock adapter body to facilitate attachment of the first end.

4. The plurality of snail lock adapters as recited in claim 2 wherein the body of each of the snail lock adapters includes an extension step adjacent the boss and axially spaced from the flat back of the second side of the body to provide a clearance of the outer periphery in the direction of the first end of the body.

5. A multiple abrasive structure support as recited in claim 1 and wherein each of the plurality of apertures each carries threads for engagement with the first end of the body of an associated one of the plurality of snail lock adapters.

6. A multiple abrasive structure support as recited in claim 1 and wherein the top plate is attached to an ordinary tool holder to facilitate the use of the multiple abrasive structure support in automated surface treatment.

* * * * *